US010358897B2

(12) United States Patent
Bowen et al.

(10) Patent No.: US 10,358,897 B2
(45) **Date of Patent: *Jul. 23, 2019**

(54) OVER-COUPLING SCREEN COMMUNICATION SYSTEM

(71) Applicant: Superior Energy Services, LLC, Harvey, LA (US)

(72) Inventors: Eddie Glenn Bowen, Porter, TX (US); Kevin Andrew Smith, Klein, TX (US); Anthony Thomas, Houston, TX (US)

(73) Assignee: Superior Energy Services, LLC, Harvey, LA (US)

( * ) Notice: Subject to any disclaimer, the term of this patent is extended or adjusted under 35 U.S.C. 154(b) by 243 days.

This patent is subject to a terminal disclaimer.

(21) Appl. No.: 15/342,657

(22) Filed: Nov. 3, 2016

(65) Prior Publication Data

US 2017/0074077 A1 Mar. 16, 2017

Related U.S. Application Data

(63) Continuation-in-part of application No. 14/702,291, filed on May 1, 2015, now Pat. No. 10,145,222.

(Continued)

(51) Int. Cl.

*E21B 43/08* (2006.01)
*E21B 34/12* (2006.01)

(Continued)

(52) U.S. Cl.

CPC ..... *E21B 43/08* (2013.01); *E21B 17/042* (2013.01); *E21B 34/12* (2013.01); *E21B 43/084* (2013.01);

(Continued)

(58) Field of Classification Search

CPC ..... E21B 43/084; E21B 43/086; E21B 2034/007; E21B 43/08; E21B 17/042; E21B 34/12

See application file for complete search history.

(56) References Cited

U.S. PATENT DOCUMENTS 4,416,331 A 11/1983 Lilly
4,509,600 A 4/1985 Boudreaux et al.

(Continued)

FOREIGN PATENT DOCUMENTS

CA 2875073 A1 12/2013
WO 2014062180 A1 4/2014

OTHER PUBLICATIONS

PCT Application No. US2015/28894; International Search Report and Written Opinion of the International Searching Authority for Applicant Superior Energy Services, LLC dated Sep. 30, 2015.

(Continued)

*Primary Examiner* — Yong-Suk Ro
(74) *Attorney, Agent, or Firm* — Jones Walker LLP

(57) ABSTRACT

A screen system formed of a first screen sub and a second screen sub joined by a connector sub. The connector sub includes (i) a pipe coupling assembly connecting the base pipes of the first and second screen subs; (ii) a substantially impermeable shroud formed around the pipe coupling assembly and creating a connector annulus between the shroud and pipe coupling assembly; and (iii) end rings including a substantially annular flow passage connecting the first and second screen annuluses to the connector annulus.

16 Claims, 12 Drawing Sheets

Related U.S. Application Data

(60) Provisional application No. 61/987,798, filed on May 2, 2014.

(51) Int. Cl.
*E21B 17/042* (2006.01)
*E21B 34/00* (2006.01)

(52) U.S. Cl.
CPC ..... *E21B 43/086* (2013.01); *E21B 2034/007* (2013.01)

(56) References Cited

U.S. PATENT DOCUMENTS 4,770,336 A 9/1988 Arterbury
5,318,119 A 6/1994 Lowry et al.
5,341,880 A 8/1994 Thorstensen et al.
5,787,980 A 8/1998 Sparlin et al.
5,868,200 A 2/1999 Bryant et al.
5,881,809 A 3/1999 Gillespie et al.
6,158,507 A 12/2000 Rouse et al.
6,405,800 B1 6/2002 Walker et al.
6,409,219 B1 6/2002 Broome et al.
6,530,431 B1 3/2003 Castano-Mears et al.
6,581,689 B2 6/2003 Halley, Jr.
6,719,051 B2 4/2004 Halley, Jr. et al.
6,749,020 B1 6/2004 Knight
6,752,207 B2 6/2004 Danos et al.
6,805,202 B2 10/2004 Gillespie et al.
7,048,061 B2 5/2006 Bode et al.
7,055,598 B2 6/2006 Ross et al.
7,717,178 B2 5/2010 Gaudette et al.
7,987,909 B2 8/2011 Pineda et al.
8,225,863 B2 7/2012 Hammer et al.
8,522,867 B2 9/2013 Yeh et al.
9,010,417 B2 4/2015 Garcia et al.
2002/0189809 A1* 12/2002 Nguyen ..... E21B 43/045 166/278
2004/0163804 A1 8/2004 Bode et al.
2009/0095471 A1 4/2009 Guignard et al.
2011/0024105 A1 2/2011 Hammer et al.
2012/0073801 A1* 3/2012 Greci ..... E21B 43/08 166/227
2012/0090831 A1 4/2012 Weirich et al.
2013/0327542 A1* 12/2013 Least ..... E21B 43/04 166/380
2014/0158373 A1* 6/2014 Least ..... E21B 17/046 166/380
2014/0231097 A1* 8/2014 Veit ..... E21B 43/04 166/378
2015/0013970 A1* 1/2015 Jaaskelainen ..... E21B 47/123 166/250.01
2015/0152715 A1* 6/2015 Cunningham ..... E21B 43/08 166/250.01
2015/0218909 A1* 8/2015 Yeh ..... E21B 43/08 166/305.1
2015/0337627 A1* 11/2015 Smart ..... E21B 43/08 166/378
2016/0376876 A1 12/2016 Provost

OTHER PUBLICATIONS

"Well Screens" brochure, Superior Energy Services.

* cited by examiner

OVER-COUPLING SCREEN COMMUNICATION SYSTEM

This application is a continuation-in-part of U.S. application Ser. No. 14/702,291, filed May 1, 2015, which claims the benefit under 35 USC § 119(e) of U.S. Provisional Application Ser. No. 61/987,798, filed May 2, 2014.

BACKGROUND OF INVENTION

The present invention relates to filtering systems used in oil & gas wells. Many well operations involve the placement of material, often via a fluid slurry, in the gap between the well casing (or wellbore in an uncased well) and another tubular string (e.g., production tubing) within the casing or wellbore. Typically fluid from the slurry is returned to the surface through a filter mechanism or "screens" positioned along the tubular string. The screens are typically formed from attaching a filtering media to the tubular string. A conventional screen assembly (also sometimes referred to as a screen "sub" or "joint") typically comprises a perforated "base pipe" with a screen material positioned around, but spaced somewhat off of, the base pipe. When multiple screen subs are positioned adjacent to one another in the tubular string, the connection between the screen subs usually forms a discontinuity in the surface area available for filtration. In many applications, it is desirable to maximize the surface area available for infiltration.

SUMMARY OF SELECTION EMBODIMENTS

In order to maximize infiltration, the areas across each unit of screen where there is no filter media, considered blank sections of a screen assembly, many embodiments are preferably equipped with a filtering mechanism which enables dehydration of a gravel slurry pumped across the blank section and contribution to and from the reservoir via perforations in a cased hole and reservoir contact in an open hole.

In other embodiments, the invention is a screen system comprising a first screen sub including a first base pipe wrapped with a first screen section; a second screen sub including a second base pipe wrapped with a second screen section; and a pipe coupling assembly joining the first and second base pipes; and a section of filter material extending between the first and second screen sections, and extending over the pipe coupling assembly, thereby forming an annular flow path from the first screen section to the second screen section over the pipe coupling assembly.

The above paragraphs present a simplified summary of the presently disclosed subject matter in order to provide a basic understanding of some aspects thereof. The summary is not an exhaustive overview, nor is it intended to identify key or critical elements to delineate the scope of the subject matter claimed below. Its sole purpose is to present some concepts in a simplified form as a prelude to the more detailed description set forth below.

DETAILED DESCRIPTION

Figure 1B:
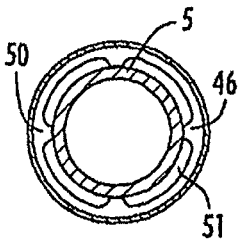
FIGS. 1A to 1C illustrate one embodiment of the present invention.
Figure 1C:
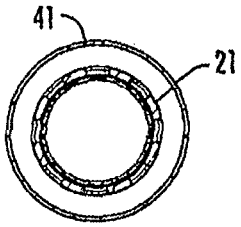
Figure 1A:
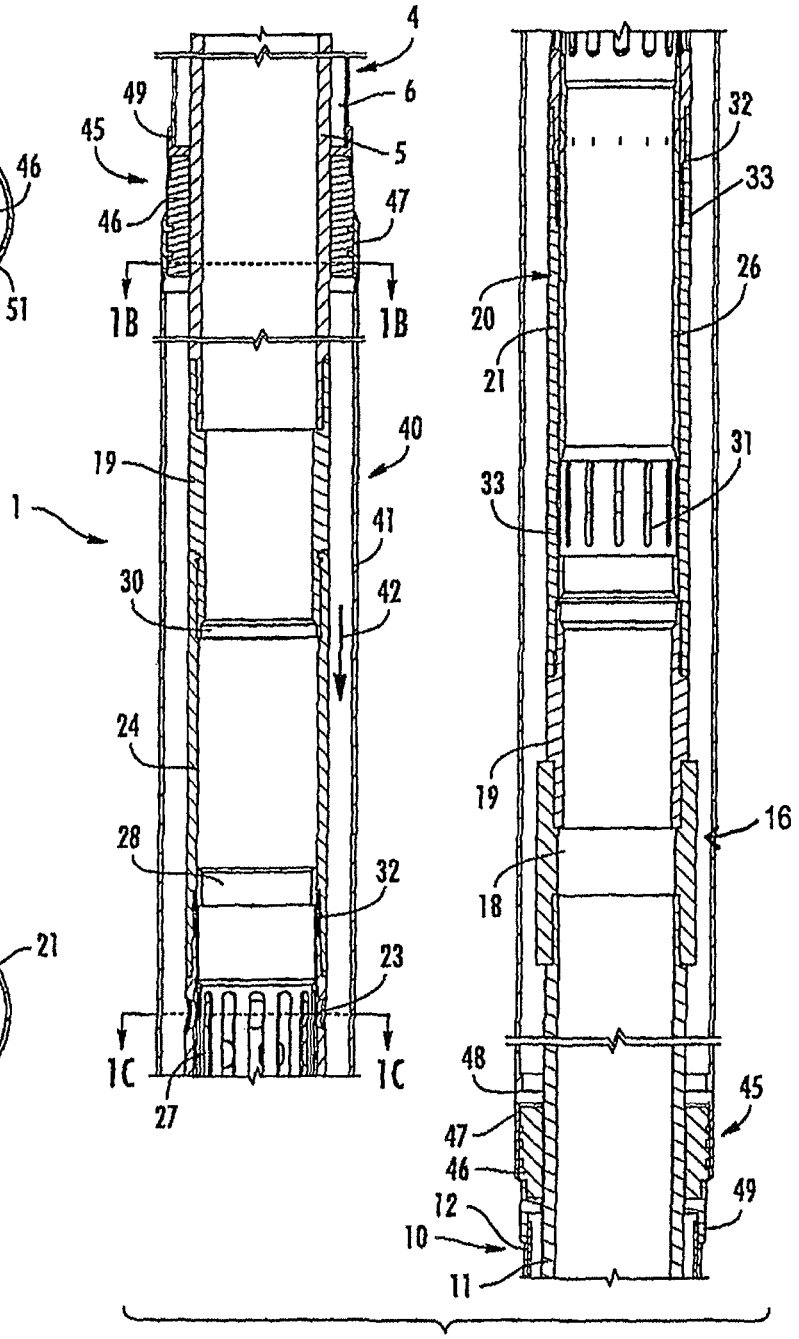

FIG. 1A illustrates one embodiment of the present invention, screen communication system or screen coupling system 1. In the most basic form, this embodiment of the screen communication system includes a first (or upper) screen sub 4, a second (or lower) screen sub 10, a pipe coupling assembly 16, and a section of filter material 40 extending between the screen subs 4 and 10. The first and second screen subs 4 and 10 generally comprise base pipes 5 and 11 and screen sections 6 and 12, respectively. FIG. 1A only illustrates the ends of screen subs 4 and 10 which are joined to pipe coupling assembly 16. In the FIG. 1A embodiment, base pipes 5 and 11 do not have inflow apertures along their length. Although not shown, it will be understood base pipes 5 and 11 could have one or more inflow valves, but certain other embodiments may have no inflow valves on base pipes 5 and 11. Typically, screen subs 4 and 10 could be any conventional or future developed screen system. Non-limiting examples of screen subs 4 and 10 may include the ProWeld™, Precision TOP, DynaFlo™, SlimFlo™, or Uniflo™ screen systems provided by the Completion Services division of Superior Energy Services, Inc. of Houston, Tex.

The components of pipe coupling assembly 16 may vary in different embodiments. In the FIG. 1A embodiment, coupling assembly 16 includes threaded base pipe coupling 18 which has internal threads engaging the external threads on base pipe 11 at one end and engaging valve connector sub 19 on the other end. In one example, any conventional thread type may be used to join base pipe 11 and base pipe coupling 18. Seen next in FIG. 1A, the opposite end of valve connector sub 19 threadedly engages the first end of valve body 21, which forms part of the overall valve assembly 20. The second end of valve body 21 engages valve body extension 24, which in turn engages a second valve connector sub 19. This second valve connector sub 19 then engages the base pipe 5 of screen sub 4. It will be understood that these components of coupling assembly 16 (including valve assembly 20) are all tubular in the sense that the coupling assembly 16 will form a continuous central flow path between base pipes 5 and 11.

Positioned within valve body 21 is sliding sleeve 26 which includes sleeve apertures 27 approximate the upper end (relative to the orientation of FIG. 1A) of the sliding sleeve 26. Valve body 21 will have corresponding body apertures 23 and seals 32 on each side of the body apertures 23. It will be readily apparent that a flow path between the interior and exterior of the valve assembly 20 may be establish and terminated by moving sleeve apertures 27 into and out of alignment with body apertures 23. In the sleeve position seen in FIG. 1A, sleeve apertures 27 and body apertures 23 are align such that valve assembly 20 is in the open position. Valve assembly 20 may be closed by sliding sleeve 26 toward screen sub 4 until sleeve 26 contacts sleeve stop 30, at which point sleeve apertures 27 are beyond seals 32 and cannot communicate with body apertures 23. In many embodiments, the sleeve valve is designed according to the "down-to-open/up-to-close" convention (where "up" is the direction coming out of the well), but naturally could be designed with the opposite opening/closing directions.

The end of sliding sleeve 26 opposite that having sleeve apertures 27 is illustrated as including a collet assembly 31. Collet assembly 31 may be a conventional set of collet fingers which engage collet profiles 33 formed on the inside surface of valve body 21. It will be understood that collet assembly 31 will releasably engage a collet profile 33 in both the open and closed position of sliding sleeve 26, thereby biasing sliding sleeve 26 in the open or closed position until sufficient force is applied to sliding sleeve 26 to force the collet fingers out of the collet profiles.

Figure 5A:
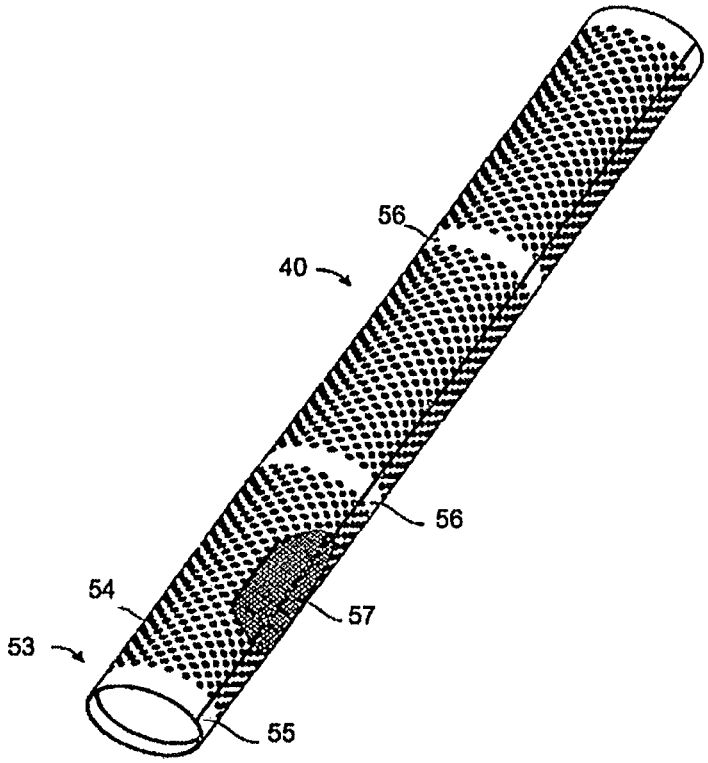
FIGS. 5A and 5B illustrate alternate embodiments of a screen material or filtration media.
Figure 5B:
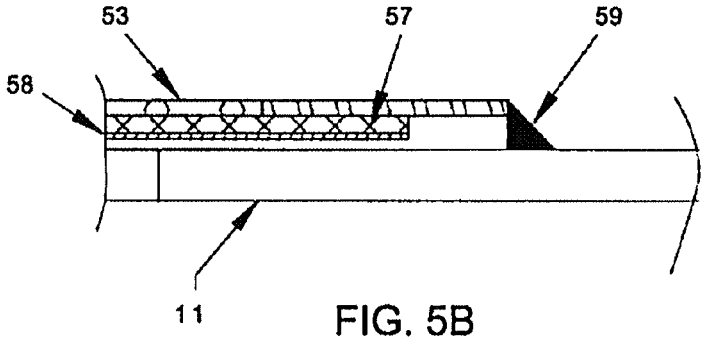

FIG. 1A further illustrates a section of filter material 40 extending between the first and second screen sections 6 and 12. The section of filter material 40 extends over the pipe coupling assembly 16 and thereby forms an annular flow path 42 from the first screen section 6 to the second screen section 12 over the pipe coupling assembly 16. Filter material 40 could be any number of materials sufficiently robust to withstand the downhole conditions which it will encounter and having sufficient filtering capacity to meet design criteria. For example, the filter material will often have an opening size or a mesh size based upon the distribution of sand grain sizes specific to the well in question. In certain embodiments, filter material 40 may be any conventional or future developed well screen structure. In the particular embodiment seen in FIG. 5A, filter material 40 forms a third screen section (between screen sections 6 and 12) which includes (i) a sheet metal section 53 with a plurality of apertures 54 formed in a tubular shape; and (ii) a screen or filter material 57 beneath the sheet metal section 53 and of a mesh size smaller than the sheet apertures 54, where the filter material 57 is diffusion bonded or sintered to the sheet metal section 53. Naturally, many other conventional or future developed connecting methods could be employed, e.g., gluing, resistance welding, ultrasonic welding, etc. FIG. 5B illustrates a slightly modified version of a filter material (i.e., screen assembly). FIG. 5B shows a partial cross-section where a base pipe 11 has an outer sheet metal section (or "outer shroud") 53 welded to base pipe 11 at point 59. This embodiment has a filter media layer 57 bonded to outer shroud 53 and a drainage layer 58 bonded to filter media 57. In one example, the filter layer is a square weave of metal wire where the openings in the weave are larger than those of the filter media layer (which is itself a tighter weave of metal wire). In FIG. 5B, a single drainage layer 58 is shown, but in alternative designs, a drainage layer may be positioned on both sides of the filter media layer.

The diffusion bonding technique is generally carried out by stacking a series of layers of metal, in one example, a filter media, a drainage layer, and a perforated shroud in a specific array. This array is then placed in a complete vacuum oven filled with an inert gas at elevated temperatures and pressures, causing the metals to be bonded together to create a very strong and robust unit as a single piece. As suggested in FIG. 5A, the sheet metal section 53 may be rolled in a cylinder shape and welded along seam 55. In this embodiment, the sheet metal apertures will often have a diameter ranging between about ¼" and ½", but can have diameters outside this range. Nor do the sheet metal apertures need to be round, but can take on any shape. In certain embodiments, such apertures will have a flow area (i.e., the opening into which fluid can flow) of between about 0.025 $in^2$ and about 1.0 $in^2$. In many embodiments, the ratio of apertures to sheet material will range between about 20% and 30%, but can less if more structural strength is necessary or greater if structural strength requirements are less demanding. The embodiment of FIG. 5A shows solid sections 56 (i.e., sections without apertures 54) to improve mechanical strength characteristics. The sheet metal (or "sheet material" if a non-metal) may be any material suitable for downhole conditions. In some instances conventional carbon steel, but more typically a stainless steel such as 304 or 316L SS in a thickness ranging from about 8 gauge to about 16 gauge.

As suggested above, the screen or filter material 57 will typically be sized based upon the distribution of sand grain sizes specific to the well in question. However, as non-limiting examples, in many embodiments the screen material will have an opening size ranging between about 125 um and about 500 um and providing an about 45% to about 60% flow area (of total surface area). Although the screen material may be formed of many compounds, two example materials are stainless steel 316L or Alloy 20. In many examples, the filter section is a woven wire material (e.g., a square weave or any of a number of other weave patterns), but could also be formed by many non-woven techniques. Naturally, alternative filter materials 40 could be formed of different materials and have size ranges outside those listed above, but still come within the scope of the present invention. An example of one suitable filter material may be found in U.S. application Ser. No. 14/031,269, filed Sep. 13, 2013, and entitled "Screen Filter," which is incorporated by reference herein in its entirety.

In the embodiment of FIG. 1A, the filter material 40 forms a connection to the screen subs' screen sections 6 and 12 by way of a screen coupler 45. This example of screen coupler 45 includes a shrink fit ring 49 securing the screen sections 6 and 12 to end rings 46. The threaded screen retainer 47, which was previously welded to filter material 40 (at weld point 48), is then threaded onto end ring 46. As suggested in FIG. 1B, end ring 46 includes an inner tubular section formed by the first base pipe 5 and an outer tubular section defining the annular flow passages 51 between the inner and outer tubular sections. FIG. 1B also illustrates how the end ring includes ribs 50 between the inner tubular and outer tubular sections and how the ribs 50 separate the annular flow passages.

As suggested in FIG. 1A, this embodiment of the filter material 40 extends substantially an entire length between the first and second screen sections, i.e., with the screen couplers 45 being the only filter material discontinuities between the screen filtering sections 6 and 12 and filter material 40. However, in alternate embodiments, the filter material may extend less than the entire length between the first and second screen sections, for example at least 80% (alternatively 70%, 60%, or 50%) of the length between the first and second screen sections.

Figure 3:
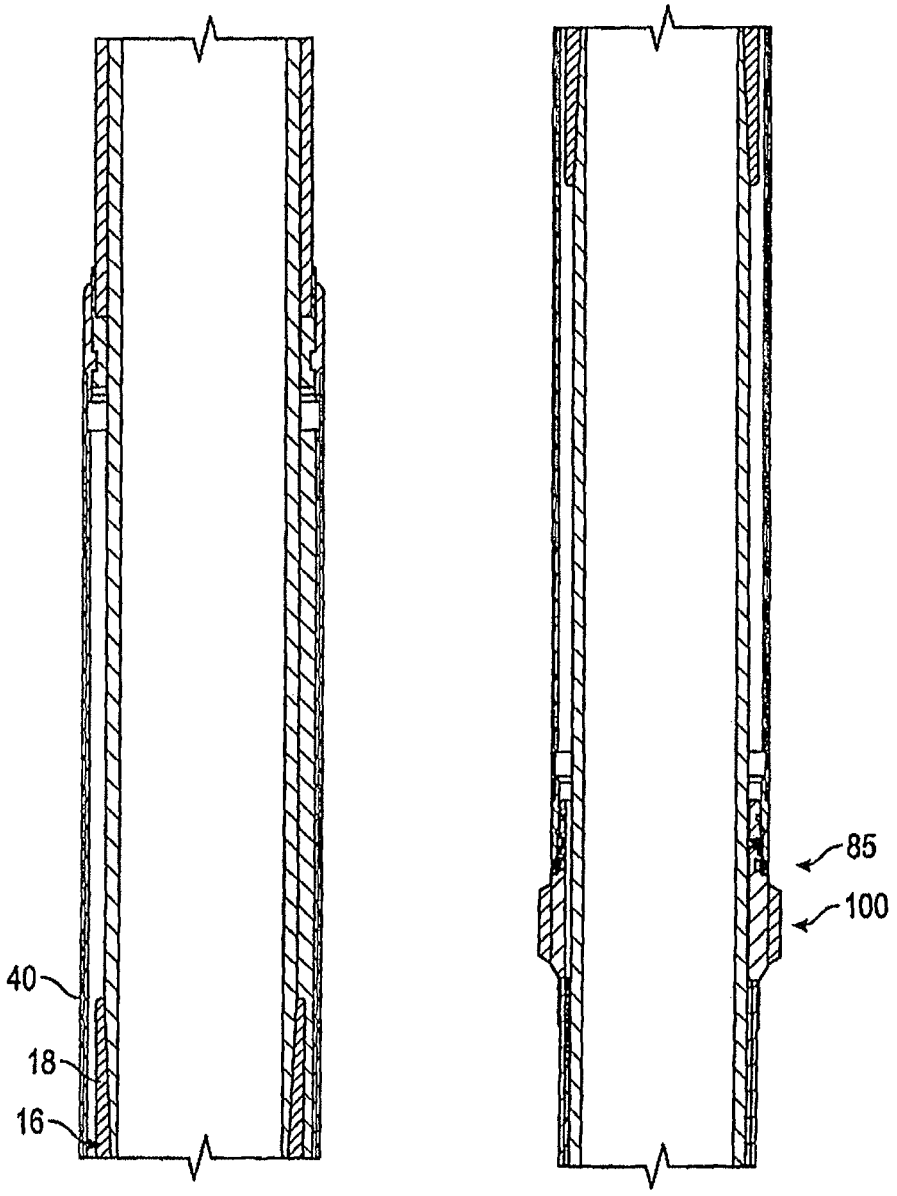
FIG. 3 illustrates an embodiment similar to FIG. 1A, but lacking a sleeve valve.

Although FIG. 1A illustrates the screen communication system as incorporating valve assembly 20, other embodiments could utilize simple continuous pipe sections having no valve structure. For example, FIG. 3 illustrates a screen communication system similar to that of FIG. 1A, but with no valve assembly 20. Instead, the pipe coupling assembly 16 consists entirely of threaded coupling 18. Additionally, this embodiment shows a centralizer 100 and rather than the threaded screen coupler 45, FIG. 3 shows a quick-connect coupling 85 which is explained in more detail below in reference to FIGS. 4A and 4B.

Figure 2B:
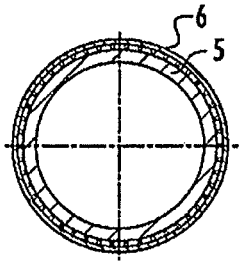
FIGS. 2A to 2C illustrate a second embodiment of the present invention.
Figure 2C:
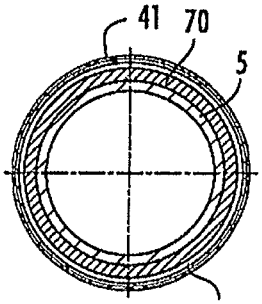
Figure 2A:
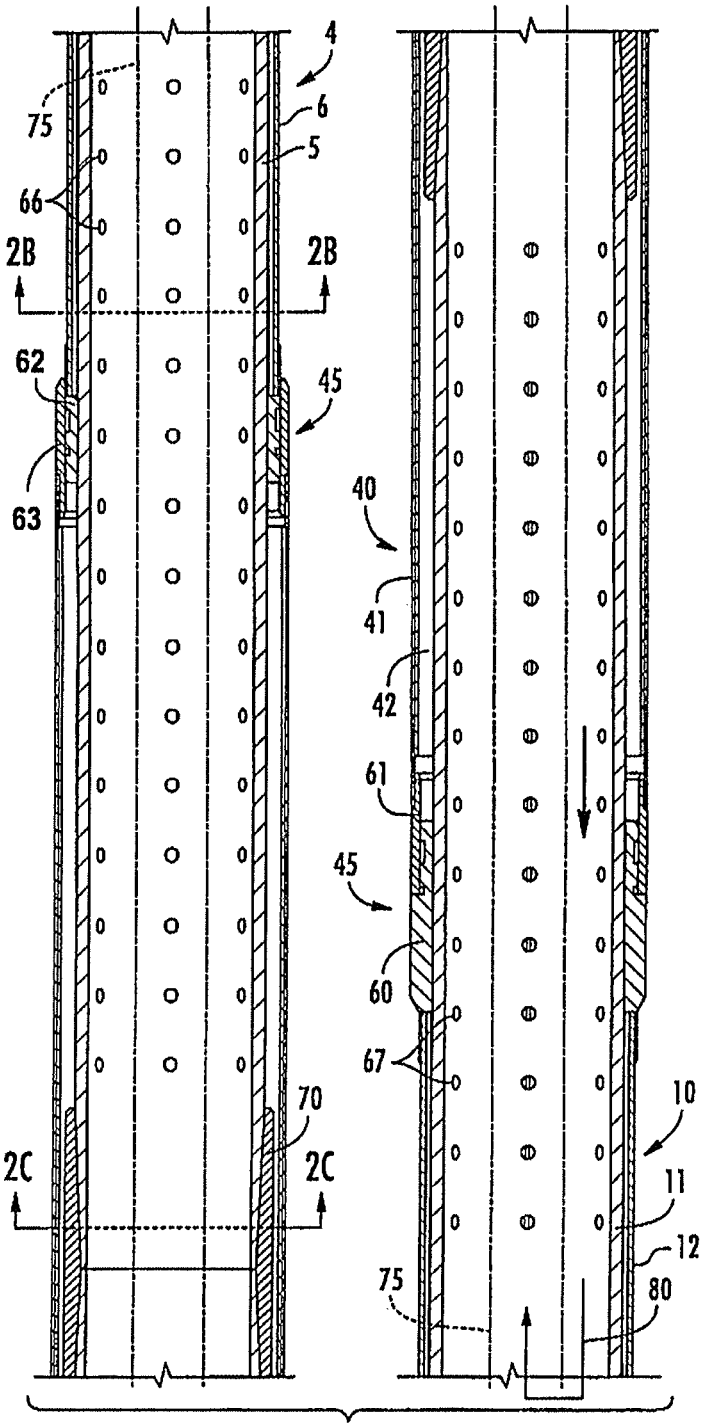

FIGS. 2A to 2C illustrate a second embodiment of the screen coupling system of the present invention. FIG. 2A shows the first and second screen subs 4 and 10 with their base pipes 5 and 11 extending to the base pipe coupler 70. The base pipes 5 and 11 are shown with a series of inflow apertures 66 and 67, respectively. Although not part of the screen coupling system, FIG. 2A also shows a conventional internal isolation string (wash pipe) 75 extending through base pipes 5 and 11. Wash pipe 75 is employed in one particular manner of using the screen coupling system as will be explained below.

The screen coupler 45 of the FIG. 2 embodiment has a more basic construction than that of the FIG. 1A embodiment. In FIG. 2A, upper screen coupler 45 is shown as constructed of primary screen retainer 62 and connecting screen retainer 63. Primary screen retainer 62 is heat shrunk to first screen section 6 and welded to first base pipe 5. Connecting screen retainer 63 is welded to filter material 40 and has inner threads which engage mating threads on the outer surface of primary screen retainer 62. FIG. 2B is a cross-section of first base pipe 5 and first screen section 6 illustrating the annular flow channels between the base pipe and screen section. FIG. 2A shows a modified lower screen coupler 45 with a somewhat different configuration of primary screen retainer 60 and connecting screen retainer 61. When the pipe is un-perforated and an inflow control device (ICD) or sliding sleeve is used to communicate the annular flow to the base pipe, there exists an axial flow path underneath the filter media. This fluid flow path is an annular flow area provided by the use of a structure supporting the filter layer and provides sufficiently large flow area such that the velocities underneath the filter media and un-perforated base pipe remain below erosion limits. FIG. 2C is a cross-section through base pipe coupler 70 illustrating the annular flow space 42 formed between base pipe coupler 70 and filter material 40 (e.g., third screen section or filter assembly 41).

As suggested above, in one example method of employing the screen coupling system of FIG. 2, the wash pipe 75 extends through base pipes 5 and 11 and provides a fluid return path. In various operations (e.g., gravel packing), fluid from the well bore annulus will be flowing though the screens of the screen subs 4 and 10 and also the section of filter material 40. This fluid will enter the base pipes and flow down (i.e., toward the low pressure end) along wash pipe 75 until reaching the end of (or other opening in) wash pipe 75 and beginning the return path to the surface. In instances where pressure distribution along the screen sections makes it advantageous to have a flow path around the screen coupling 45, the fluid path is formed by fluid entering (for example) through the filter assembly 41, flowing past the coupling in the annular space between the base pipe and wash pipe 75, and then entering wash pipe 75 as suggested by flow path 80.

Figure 4A:
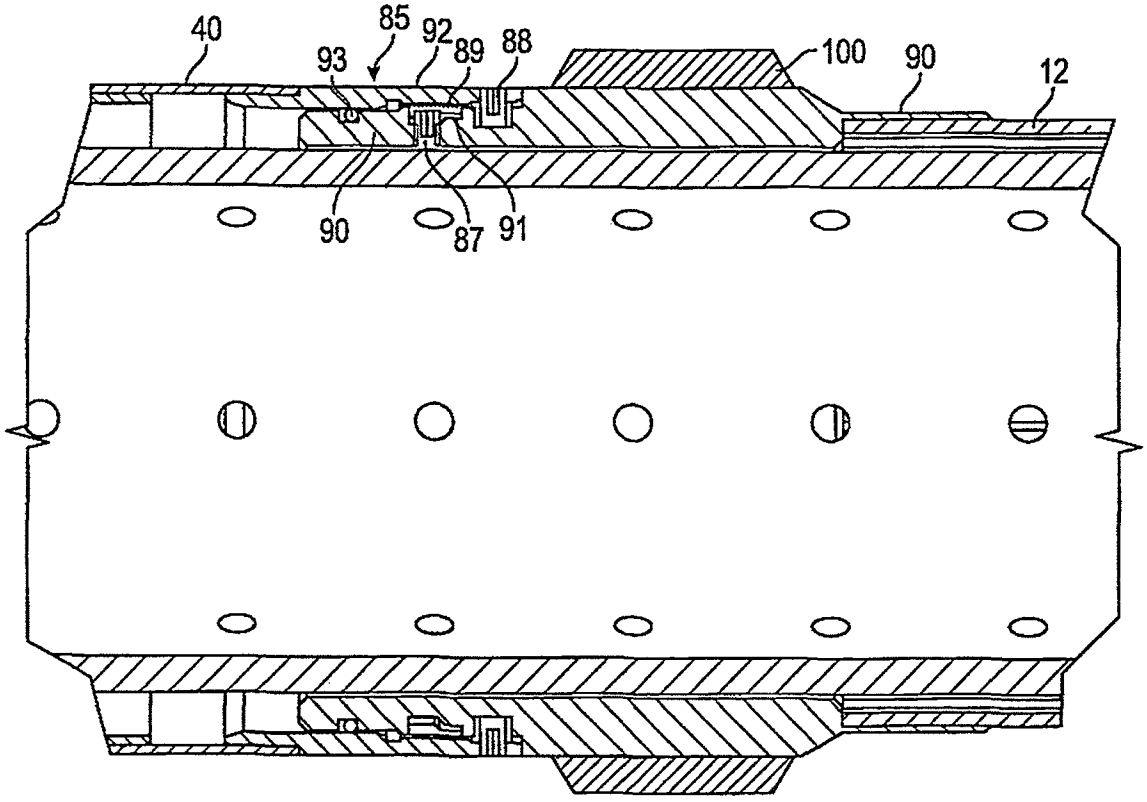
FIGS. 4A to 4E illustrate embodiments of a quick-connect assembly.
Figure 4B:
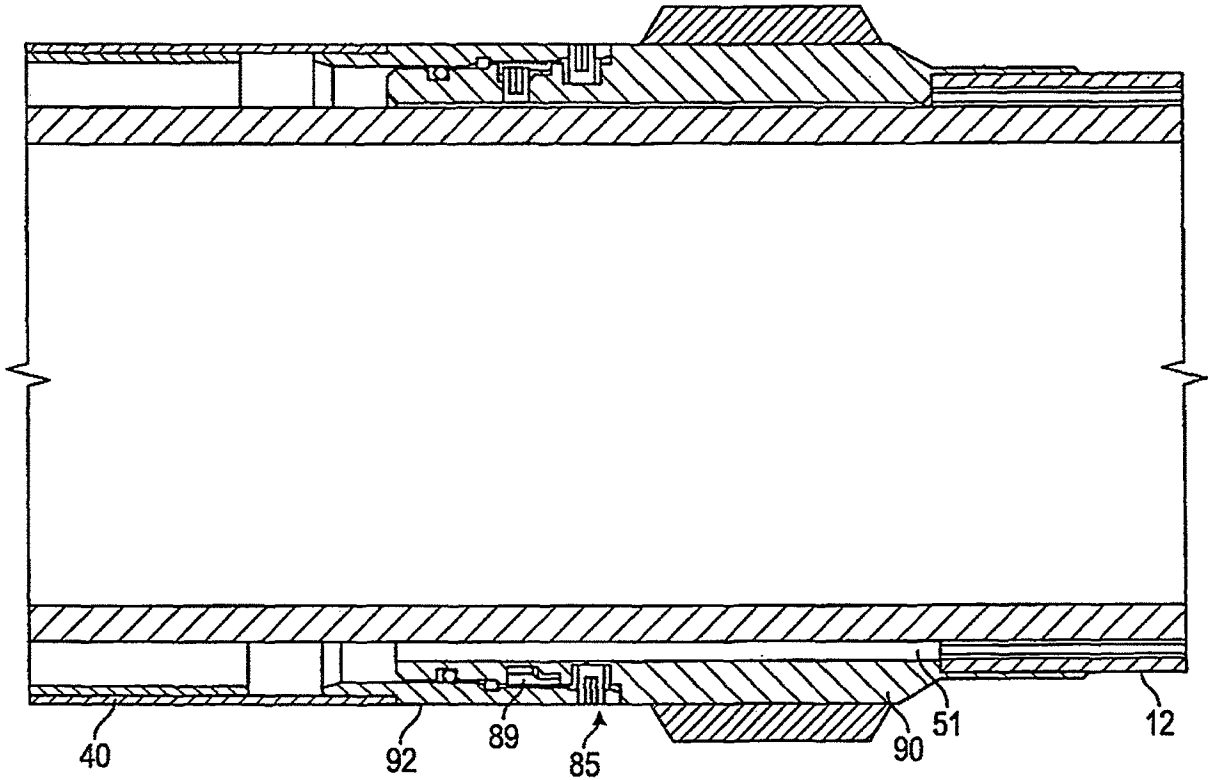
Figure 4E:
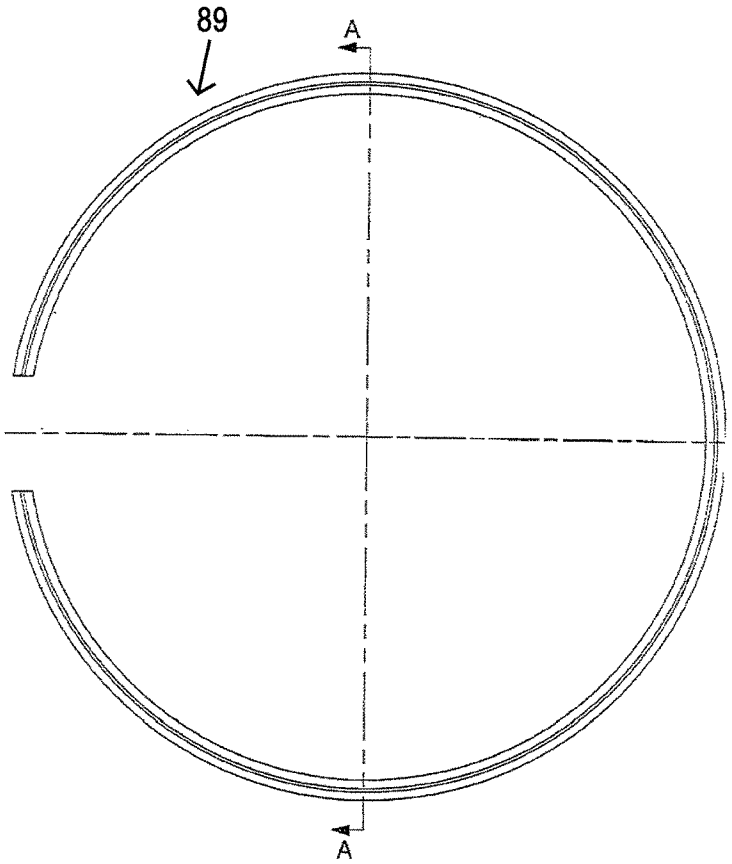

In many embodiments, the connection between the screen subs (both upper and lower screen subs 4 and 10) and the section of filter material or media 40 will be by a conventional threaded means. For example, in the FIG. 2 embodiment, the connecting screen retainer has internal threads which engage and thread onto external threads on primary screen retainer 60. However, FIG. 4A suggests one quick-connect mechanism or assembly 85 which joins the upper and lower screen subs 4 and 10 to the section of filter material 40 without rotation (or substantially no rotation, e.g., less than one revolution). The illustrated embodiment of quick-connect assembly 85 (also sometimes referred to as a "linear movement connector") generally includes an attachment ring 92 heat shrunk to filter material 40 and a screen end ring 90 welded to the lower screen section 12 of lower screen sub 10. FIG. 4C illustrates attachment ring 92 in greater detail. The portion of screen end ring 90 most proximate to filter material 40 will have an outer diameter which allows it slide within the inner diameter of attachment ring 92. This portion of screen end ring 90 will also have a lock ring channel 91 sized to accommodate the body lock ring 89. In one embodiment better seen in FIG. 4E, body lock ring 89 is less than a full ring section, thereby allowing the ring to compress slightly and marginally reduce its diameter. Body lock ring 89 is also preferably formed of a material giving it a spring bias toward the expanded (wider diameter) state. In the example embodiment of FIG. 3, the quick-connect assembly 85 is only used at the lower connection point of filter material 40 and the upper connection point is made simply using a set screw with a debris barrier.

Figure 4D:
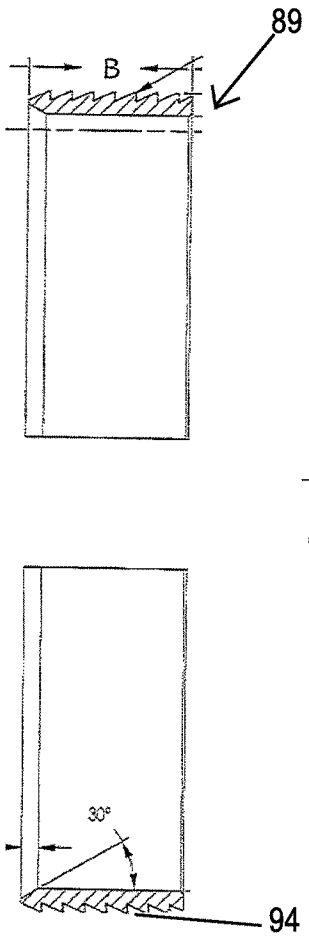
Figure 4C:
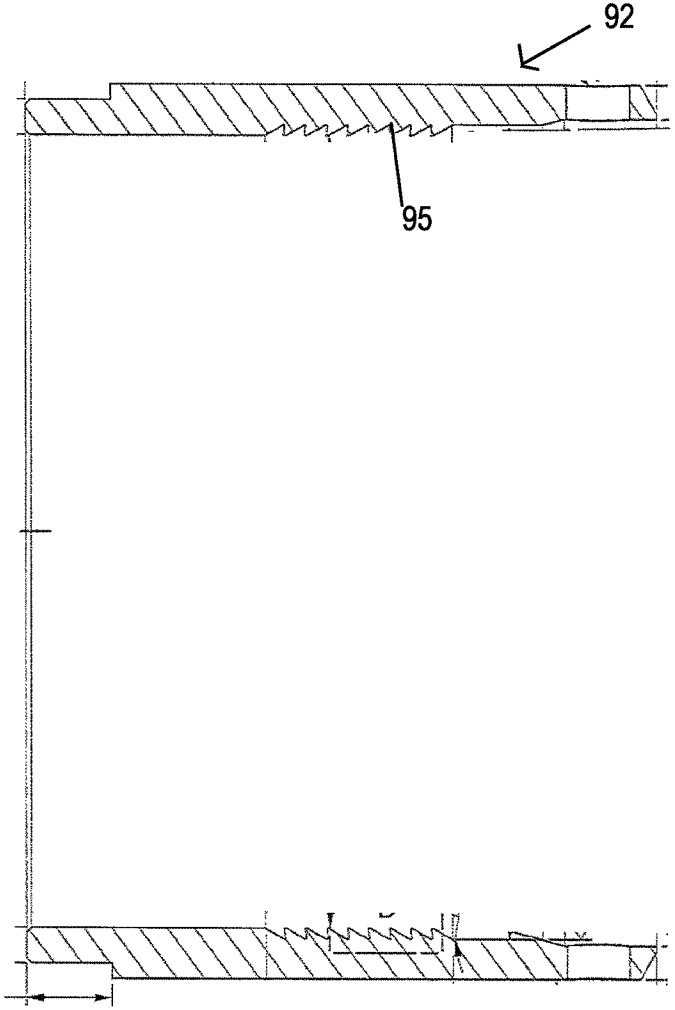

As best seen in FIG. 4D, formed on the outer surface of body lock ring 89 will be a series of ratchet teeth 94 having surfaces sloped away from attachment ring 92 and opposing vertical surfaces. A set screw (or other set member) 87 acts to prevent body lock ring 89 from rotating in lock ring channel 91. FIG. 4C also shows how a corresponding, but oppositely orient series of ratchet teeth 95 are formed on the inner surface of attachment ring 92. In this embodiment, the opposing pair of ratchet teeth also have a standard thread inclination, thereby allowing relative rotation between screen end-ring 90 and attachment ring 92 to cause these elements to engage and disengage. It may be visualized how, prior to assembly, screen end-ring 90 and attachment ring 92 are separated. In order to join these elements, attachment ring 92 is inserted over screen end ring 90 and their respective ratchet teeth forced to engage. Since body lock ring 89 has the capacity to marginally decrease its diameter and since the sloped surfaces of the ratchet teeth face one another, the ratchet teeth can slide past one another until screen end-ring 90 and attachment ring 92 are fully engaged and a seal formed by o-ring 93. Now, any separating force acting on screen end-ring 90 and attachment ring 92 will be resisted by the vertical surfaces of the ratchet teeth and the tendency of body lock ring 89 to expand. It can be understood how quick-connect assembly 85 may be considered a linear movement connector since it allows for connection of the screen end-ring and the screen attachment ring without rotative motion (i.e., conventional threaded connections).

In the FIG. 4A embodiment, a second set screw 88 is positioned to engage screen end-ring 90 and attachment ring 92 in order to prevent relative rotation between these components. It will be understood that when second set screw 88 is removed, relative rotation of screen end-ring 90 and attachment ring 92 will allow these elements to again be separated even though the ratchet teeth would otherwise resist movement in the linear direction. FIG. 4A also illustrates how screen end ring 90 will include a centralizer 100 formed by a series of centralizer fins positioned around the perimeter of screen end ring 90.

FIG. 4B illustrates a slightly modified embodiment of the quick-connect assembly 85. This version the quick-connect assembly has the components seen in FIG. 4A, including screen end-ring 90, attachment ring 92, and body lock ring 89. However, this quick-connect assembly 85 further includes the flow path or flow channel 51, thereby allowing fluid to pass directly through quick-connect assembly 85 from the flow annulus under screen 12 to the flow annulus under filter material 40. The flow channel 51 allows this embodiment of quick-connect assembly 85 to provide a suitable connector for use in the embodiment of FIG. 1A.

Figure 6C:
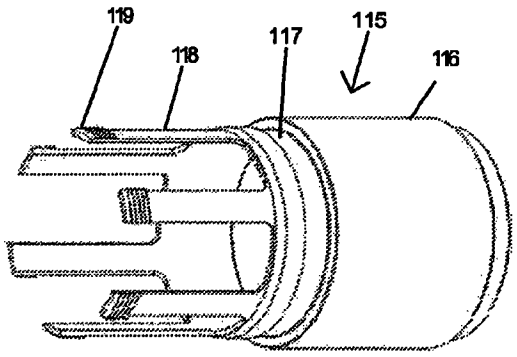
FIGS. 6A to 6C illustrate a third embodiment of a quick-connect assembly.
Figure 6B:
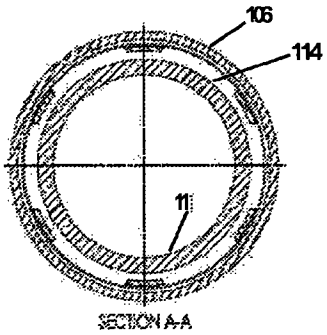
Figure 6A:
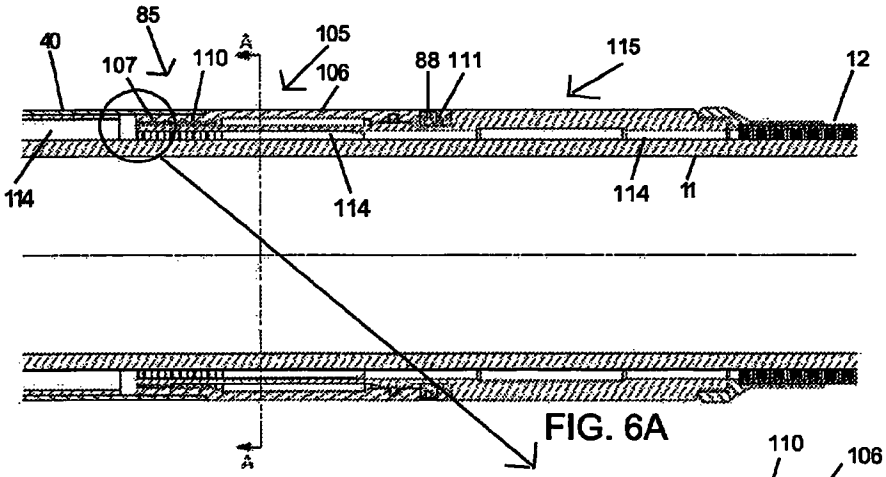
Figure 6A:
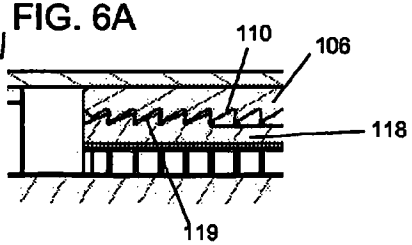

FIGS. 6A to 6C illustrate a third embodiment of a quick-connect assembly 85 (or a "linear movement connector"). In FIG. 6A, the female coupler assembly 105 includes outer body 106 which is welded to filter material 40 at weld point 107. Female coupler assembly 105 may be considered one embodiment of a screen attachment ring. Formed on the inner surface of outer body 106 (facing inward toward base pipe 11) are a series of female buttress threads, i.e., saw-tooth threads, 110. The detail associated with FIG. 6A illustrates how the buttress threads have an inclined surface on one side and a vertical surface on the other side, i.e., vertical in the sense of being perpendicular to the inner surface of outer body 106 on which the threads are formed. The female coupler assembly 105 engages the male coupler assembly 115, which is illustrated in the cross-section of FIG. 6A and the perspective view of FIG. 6C. Male coupler assembly 115 includes body section 116 which is connected on one end to the screen section 12. Male coupler assembly 115 may be considered one embodiment of a screen end ring. The opposite end of body section 116 terminates with the engagement groove 117 and a series of finger sections 118 extending beyond engagement groove 117. The outer surface on the ends of finger sections 118 will include the male buttress threads 119. Like the female buttress threads 110, the male buttress threads 119 have opposing inclined and vertical surfaces. It can be seen how male buttress threads and female buttress threads form a pair of opposing ratchet teeth.

Viewing FIG. 6A, it may be envisioned how the separated male coupler assembly 115 will slide into engagement with the female coupler assembly 105. When a force in the direction of combining the coupler assemblies causes the male buttress threads 119 encounter the female buttress threads 105, the inclined surfaces will move past one another, allowing the two coupler assemblies to inter-lock. However, axial force in the direction separating the coupler assemblies will cause the vertical surfaces of the buttress threads to engage and resist such force. The movement of male coupler assembly 115 into female coupler assembly 105 is limited by the engagement shoulder 111 on outer body 106 dropping into engagement groove 117 on male coupler assembly 115. FIG. 6A also shows the set screw 88 passing though outer body 106 and engaging main body 116 to prevent their relative rotation. As is well understood in the art, while buttress threads 110 and 119 resist an axial disengaging force, relative rotation between the two coupler assemblies will allow threads 110 and 119 to disengage. As seen in FIGS. 6A and 6B, this configuration creates a continuous passage 114 which allows fluid to pass through the male and female coupler assemblies from one screen area to another.

Figure 7C:
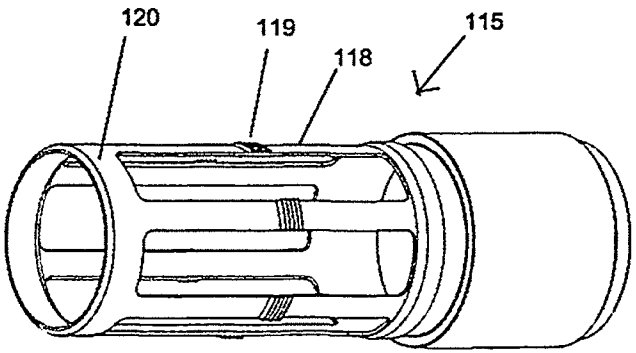
FIGS. 7A to 7C illustrate a fourth embodiment of a quick-connect assembly.
Figure 7B:
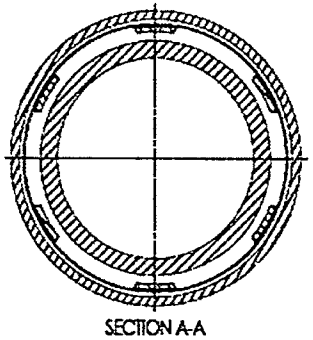
Figure 7A:
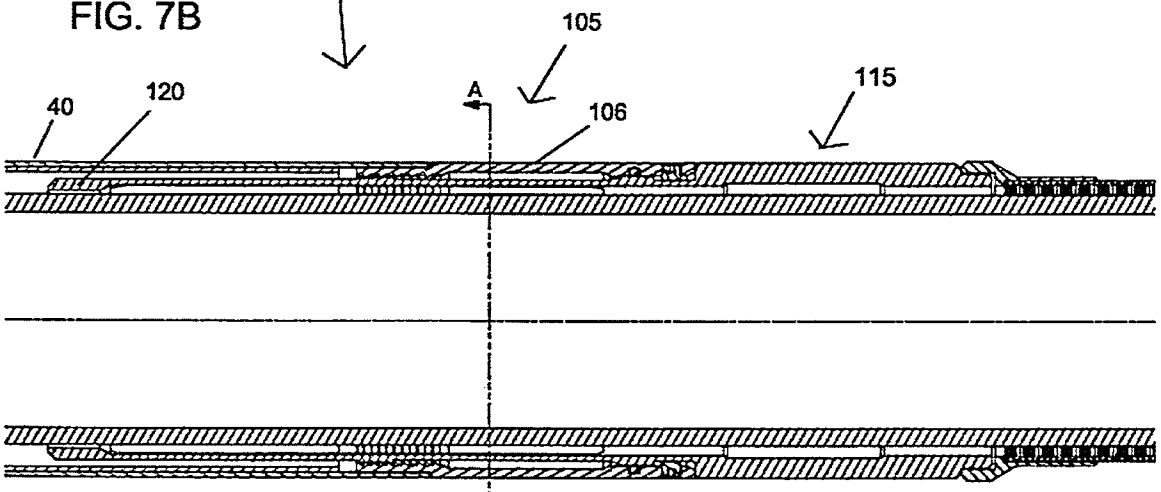

FIGS. 7A to 7C illustrate a slightly modified embodiment to that seen in FIGS. 6A to 6C. Like the FIG. 6 embodiment, FIG. 7A shows male coupler assembly 115 engaging female coupler assembly 105. The main difference in the FIG. 7 embodiment is that the male coupler assembly 115 as best seen in FIG. 7C. This version of male coupler assembly 115 includes the closed ring section 120 formed at the ends of fingers 118. The closed ring section 120 holds the individual fingers 118 rigidly in place and acts to prevent the bending of fingers 118 from careless handling or assembly. Such bending or other damage is a greater possibility when employing the open ended or "cantilevered" fingers 118 seen in FIG. 6C. The closed ring section 120 of FIG. 7C creates a "beam" configuration where the fingers are supported at both of their ends.

Figure 8:
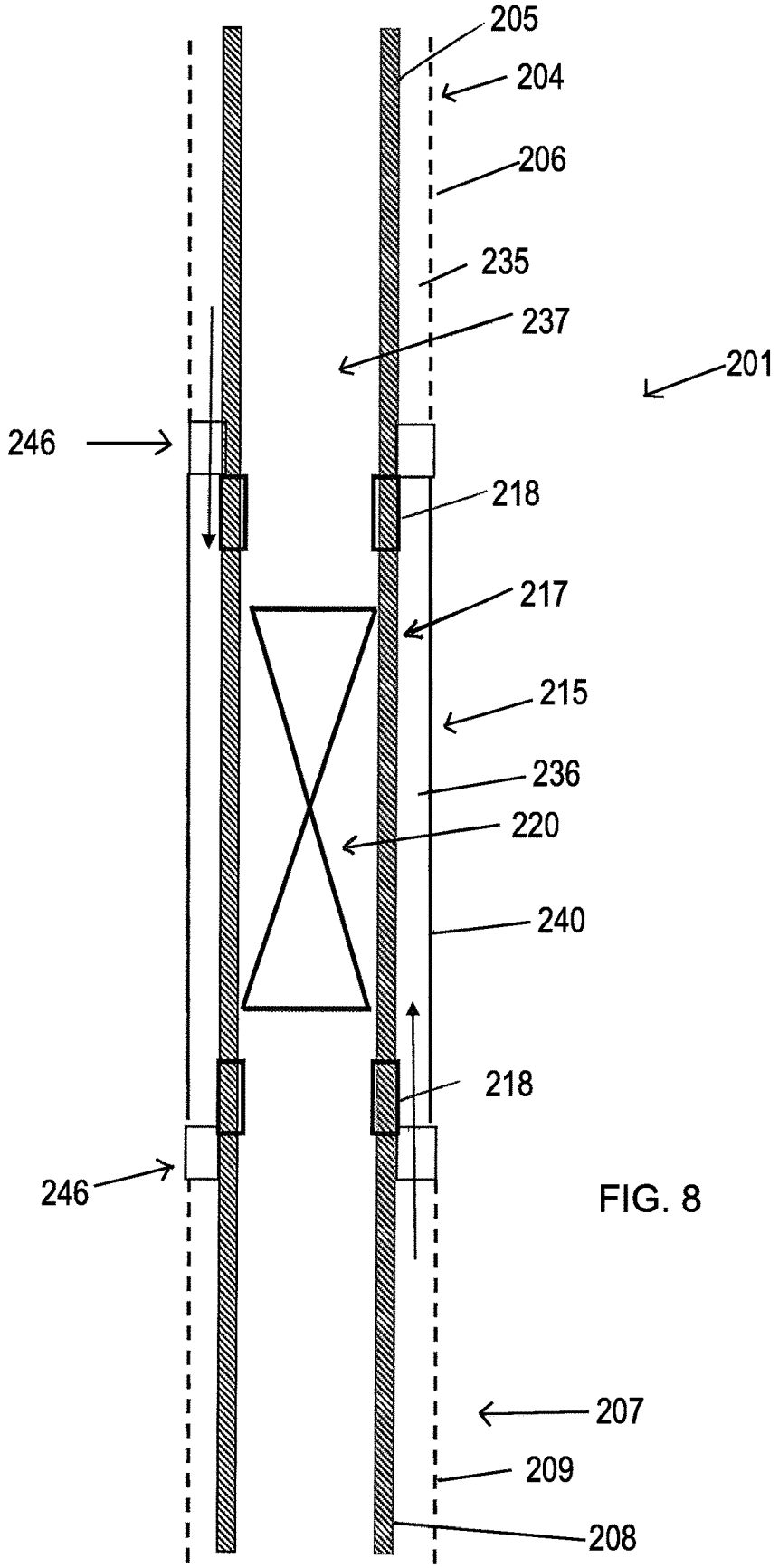
FIG. 8 illustrates one embodiment of a well screen system of the present invention.

FIG. 8 illustrates another embodiment of the invention, which is the well screen system 201. FIG. 8 is a schematic drawing with most of the components being similar to those described above, but being schematically illustrated by more simplistic lines and blocks. Very generally, the FIG. 8 well screen system comprises first screen sub 204 joined to second screen sub 207 by the connector sub 215. First and second screen subs 204 and 207 include their respective base pipes 205/208, screen sections 206/209, and screen annuluses 235 formed between the base pipes and screen sections. Examples of screen subs 204 and 207 may include any conventional or future developed screens subs, including the ProWeld™, Precision TOP, DynaFlo™, SlimFlo™, or Uniflo™ screens referenced above. The screen subs 204 and 207 are joined to connector sub 215 in a manner similar to those described above. The base pipe connector 218 may be a connector similar to the valve connector sub 19 described in conjunction with FIG. 1A. Pipe connector 218 will function to join base pipe 205 with the connector sub's pipe coupling assembly 217, thus forming a substantially continuous central passage 237 through the screen system. In the FIG. 8 embodiment, the pipe coupling assembly 217 is the same as the pipe coupling assembly 16 described in reference to FIG. 1A. This could include the valve connector sub 18 and the valve assembly 20 seen in FIG. 1A, the latter of which is represented schematically as valve 220 in FIG. 8. However, other embodiments of connector sub 215 could not include a valve assembly. For example, the pipe coupling assembly 217 could alternatively be a simple base pipe coupling 70 with short lengths of based pipe (perforated or unperforated) extending from coupling 70 as seen in FIG. 2. In one preferred embodiment, valve 220 is a pressure activated sliding sleeve valve, i.e., a valve which can be opened by induced pressure changes downhole and does not require a tool lowered on wire line or coiled tubing to mechanically engage the sliding sleeve. One example of such a pressure activated valve is the Pressure Actuated Circulating (PAC) valve available from Superior Energy Completion Services of Houston, Tex.

Another component of connector sub 215 is the shroud 240 which wraps around (or houses) pipe coupling assembly 217 to form the connector annulus 236 between shroud 240 and pipe coupling assembly 217. In the illustrated embodiment, shroud 240 is a "substantially impermeable" shroud, i.e., the amount of fluid, if any, which can pass through shroud 240 is insignificant to the function of shroud 240. Stated in another manner, "substantially impermeable" means that only a very small percentage of the surface area of shroud 240 is permeable (e.g., includes apertures), for example, alternatively, less than 5%, less than 2%, less than 1%, less than 0.5%, less than 0.1%, or less than 0.01% of shroud 240's surface area would allow the passage of fluid. However, there could be alternative embodiments where shroud 240 is permeable, for example, shroud 240 could be formed of a filter material such as described above for the screen section 41 in FIG. 1A or have a series of apertures such as the base pipe described in conjunction with FIG. 2A. In one preferred embodiment, shroud 240 is formed of a material such as 10 gauge stainless steel sheet metal, but shroud 240 could be formed of enumerable different materials which can function under the mechanical, pressure, and corrosive conditions expected to be encountered within the wellbore. In certain embodiments, shroud 240 will have a length (distance between end rings 246 described below) of between about 4 feet and about 10 feet.

The connector annulus 236 will be fluidly joined to the screen annuluses 235 by the end rings 246 seen in FIG. 8. End rings 246 may be the same structure as end rings 46 (along with the other structure of screen coupler 45). Rather than the screen coupler 45 attaching to the screen material 41 as in FIG. 1, the end rings 246 will attach to the shroud 240 in FIG. 8. Thus, end rings 246 create a substantially annular flow passage connecting the screen annuluses to the connector annulus. The flow passages through end rings 46 are "substantially annular" in the sense that ribs 50 (see FIG. 1B) break the annulus into discrete passages. However, even with the ribs 50, a significant majority of the annular space within the end rings remains substantially unobstructed. The comparatively large flow passages between the ribs 50 (e.g., providing at least 50%, 60%, 70%, or 80% of the flow area of the adjacent screen annulus) may be distinguished from certain prior art screen communications systems which use shunt tubes to connect between adjacent screen subs, i.e., the combined area of the shunt tubes is less than 50% of the flow area of the adjacent screen annulus.

Figure 9:
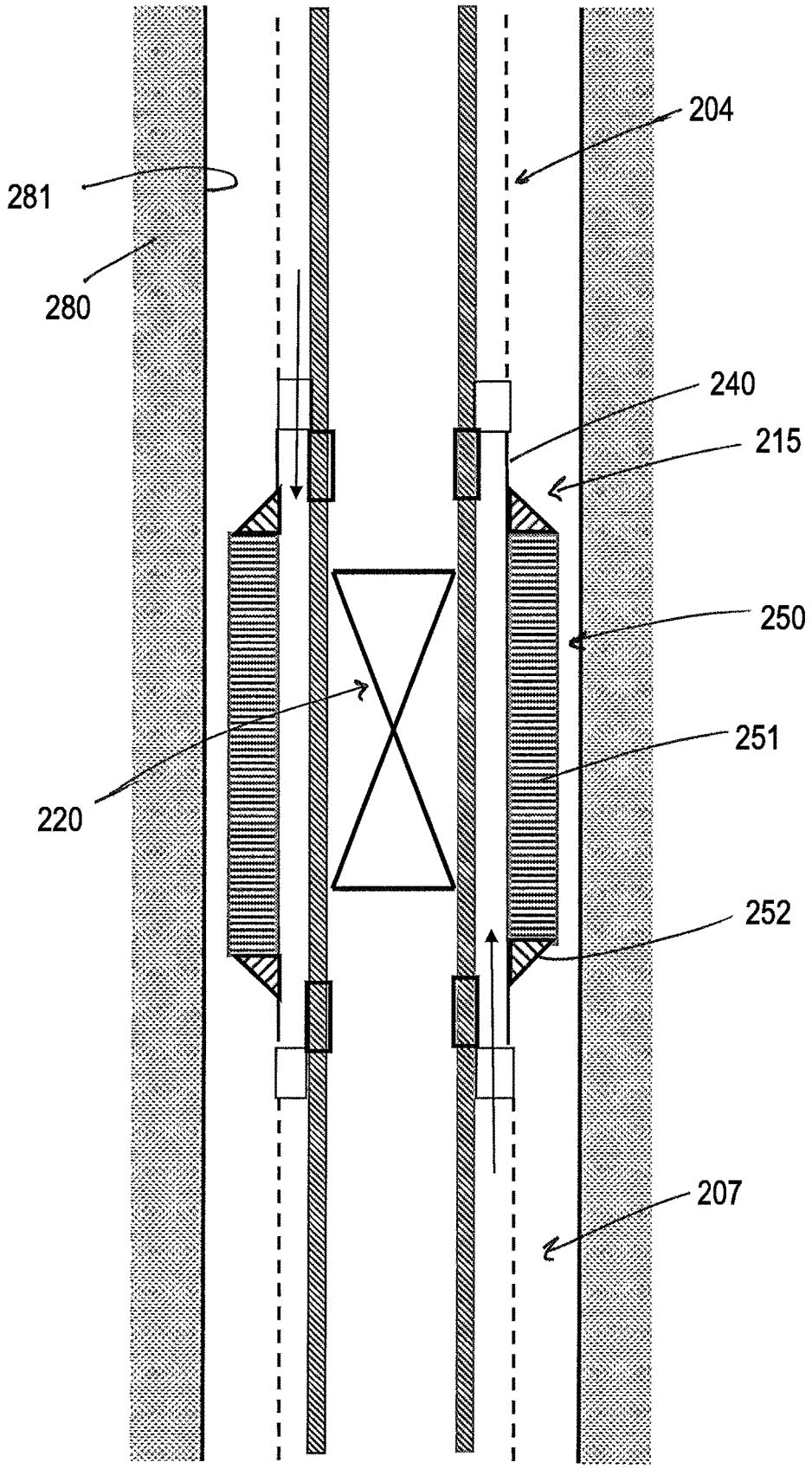
FIG. 9 illustrates a second embodiment of a well screen system of the present invention.

FIG. 9 illustrates a variation on the connector sub 215 seen in FIG. 8. In the FIG. 9 embodiment, a packer element 250 is positioned on shroud 240. In a preferred embodiment, the packer element 250 is a swellable type packer. Swellable packers generally comprise an oil-swellable elastomer 251 mounted on a base pipe or tubular (hidden from view in FIG. 9) and contained against axial (i.e., along the length of the base pipe) expansion of the elastomer by end rings 252. As is well known in the art, when the swellable elastomer is exposed to hydrocarbon based fluids, the elastomer swells in the radial direction until it engages the wellbore casing 281 (or the wellbore wall if employed in an open or uncased wellbore). The packers may also be designed with elastomers which expand in the presence of water or water-based fluids (e.g., brines). The length of the swellable packer positioned on shroud 240 is determined by factors such as the required differential pressure, the well temperature, and intended application. The packer may run along substantially the entire length of shroud 240 or some fraction of that length. In some applications, the swellable packer is a continuous length of polymer material, while in other applications, a series of shorter length swellable packers are positioned in series along shroud 240. Nonlimiting examples of such swellable packers include the AI Packer™ and AI SlipOn™ available from Superior Energy Completion Services of Houston, Tex. Of course, packer types other than swellable packers might be employed if such packers otherwise meet the parameters of the specific application. FIG. 9 illustrates a valve 220 positioned within the screen connector 215. However, other embodiments similar to the FIG. 9 screen connector could have no valve within the screen connector.

Figure 10:
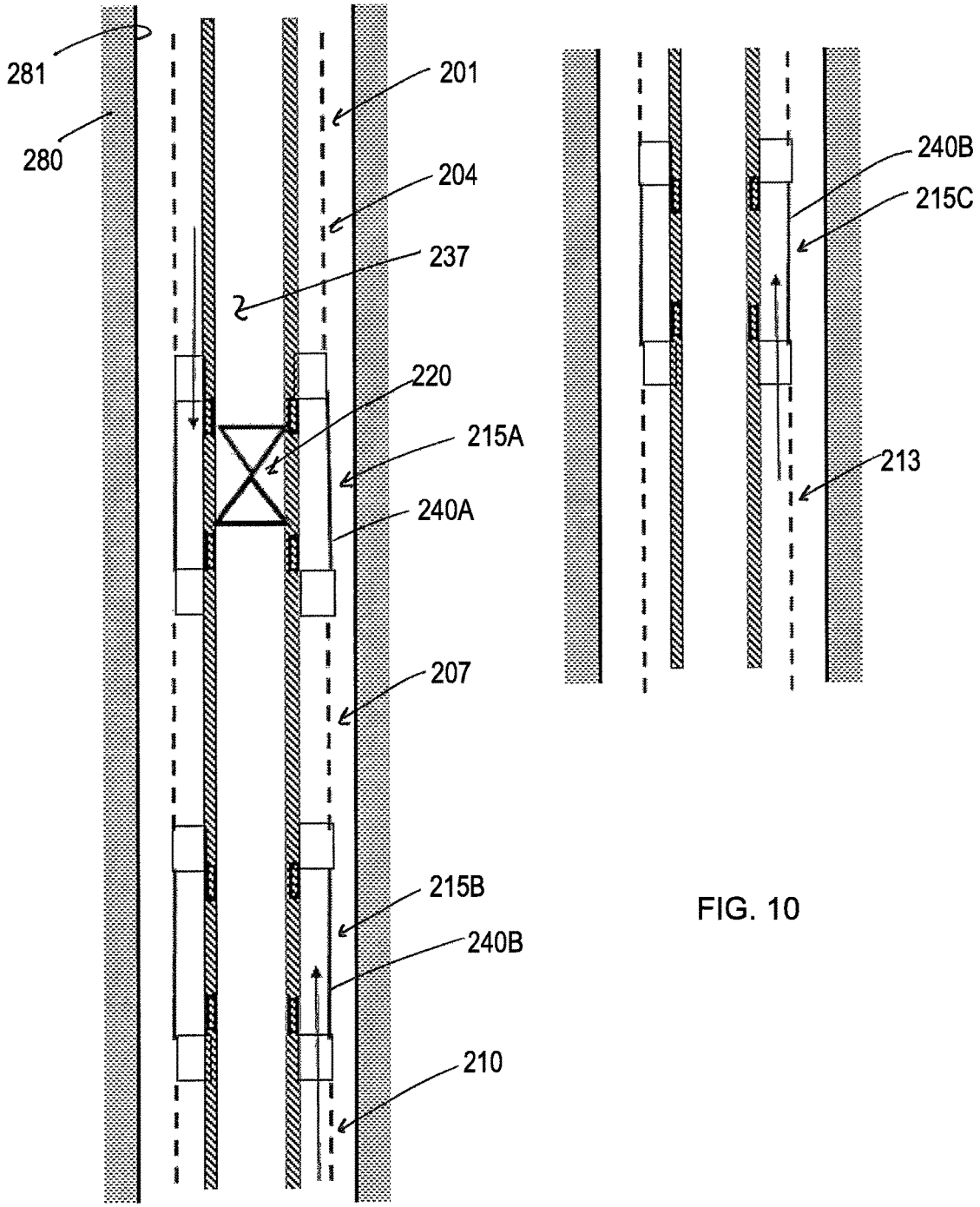
FIG. 10 illustrates a third embodiment of a well screen system of the present invention.

The connector subs described above may be employed in wellbores in many different configurations depending on the nature of the well and specific operation being performed. FIG. 10 suggests one configuration where the screen system 201 is positioned in a wellbore with casing 281, but these configurations could also be used in uncased or "open" wellbores. In this example, the screen system is in a particular zone 280 which subjects at least the connector sub 215A to a high velocity solids laden fluid flow. For example, a solids laden fluid may include a liquid hydrocarbon or gas hydrocarbon carrying sand particles from the formation toward the screen system. The flow conditions in "high flow zone" 280 are such that a screen at shroud 240A and an open valve 220 will create a large enough pressure gradient to generate a high velocity solids laden fluid flow across the screen. In one embodiment, "high velocity" means a fluid velocity of at least about 3 ft/sec, but alternatively could mean fluid velocities of at least 2, 4, 5, 6, 7, 8, 9, or 10 ft/sec. In FIG. 10, the connector sub 215A connects the screen subs 204 and 207. The connector sub 215A includes the valve 220 and an impermeable (or "solid") shroud 240A. A second connector sub 215B connects screen sub 207 to screen sub 210 while a third connector sub 215C connects screen sub 210 to screen sub 213. In this embodiment, neither connector sub 215B nor 215C will have a valve 220. Likewise, the shrouds 240B on both the connector subs 215B and 215C will be perforated (i.e., substantially permeable) or may be formed of a screen material. It will be understood that the permeable shrouds 240B and 240C allow the inflow of formation fluids into the annular spaces not only along the screen subs, but also along the connector subs 215B and 215C, thereby allowing the overall screen system to maximize fluid inflow. Because the connector base pipes under permeable shrouds 240B are not perforated nor have an open valve, the pressure gradient across these shrouds (screens) is not large enough to generate a high velocity flow of fluid. However, at connector sub 215A, which houses valve 220, a high pressure gradient could exist across a permeable shroud or screen when valve 220 is open. Therefore, shroud 240A in this embodiment is impermeable and prevents the situation of a potentially damaging high fluid velocity flow ("hot-spotting") across a section of screen material in the immediate vicinity of the open valve.

In another alternative method, the screen sub system of FIG. 10 is positioned within a wellbore. In this method, the shrouds 240 on both connector subs 215A and 215B are impermeable. Because of the extreme environments of wellbores at depth, it is not uncommon for sliding sleeve valves to fail to open. Therefore, when the valve 220 has failed to open, an alternative flow path into the central flow passage of the screen sub system may be established through the pipe coupling assembly of the second connector sub 215B. This alternative flow path is created by positioning within the pipe coupling assembly of second connector sub 215B a plurality of low damage perforating charges, for example as on a conventional perforating gun. Low damage perforating charges are known in the well completion industry. These types of perforating charges are also known as "tubing puncher" charges or extremely shallow penetrating charges. The shallow penetrating can be accomplished by combinations of explosive quantity and type, charge case and charge liner size, and focusing shape. These charges can be specifically designed to penetrate only a certain depth of material, e.g., penetrate only the base pipe, penetrate only the base pipe and casing, or penetrate only through cement layer and not significantly into formation.

The shallow penetrating charges of the current embodiment are configured to penetrate only the pipe material of the pipe coupling assembly, but not penetrate the impermeable shroud. In this manner, when the shallow penetrating charges are detonated, the series of apertures created by the charges form a flow path between the connector sub annulus and the central flow passage of the screen sub system, thereby functioning in the place of the valve 220 which failed to open. In some instances, there could be minor damage and even some perforation of the shroud, but as long as the shroud remains substantially impermeable, the method may be effective.

It will be understood that any of the above screen system configurations or methods may be employed in combination with a conventional gravel packing technique as part of the overall well completion procedure. As is well known in the art, gravel packing involves the pumping of a gravel slurry (with a specifically designed range of gravel sizes) into the well annulus, allowing the fluid in the slurry to return through the screens while the gravel forms a "pack" in the annulus between the screens and wall of the wellbore.

The term "about" when used before a numerical designation, e.g., temperature, time, amount, and concentration, including range, indicates approximations which may vary by (+) or (−) 20%, 15%, 10%, 5% or 1%. The use of the terms "first," "second," and "third" screen sub do not indicate the screen sub's location in the wellbore, i.e., the first screen sub is not necessarily the screen sub closest to the well surface, but could be the screen sub closest to the toe of the wellbore. Likewise, the "first" screen sub could have other screen subs positioned above and below it in the screen system. Similarly, additional screen subs could be positioned between a claimed "first" screen sub and a claimed "second" screen sub. "First" and "second" screen subs simply refer to at least two screen subs being located somewhere in the screen system. Although the invention has been described in terms of certain specific embodiments, those skilled in the art will readily recognize many obvious modification and variations thereof. All such modifications and variations are intended to come within the scope of the following claims.

The invention claimed is:

1. A screen system comprising:

a. at least first, second, and third screen subs, each screen sub including a base pipe wrapped with a screen section to create a screen annulus;

b. a first connector sub connecting the first and second screen subs and a second connector sub connecting the second and third screen subs, the first and second connector subs each comprising:

i. a pipe coupling assembly connecting the base pipes of the respective screen subs;

ii. a shroud formed around the pipe coupling assembly and creating a connector annulus between the shroud and pipe coupling assembly;

iii. end rings including a substantially annular flow passage connecting the screen annuluses of the respective screen subs to the corresponding connector annuluses;

c. wherein only one of either the first connector sub or the second connector sub includes a valve configured to be selectively openable in order to create a fluid path between a central passage of the pipe coupling assembly and the connector annulus; and d. at least one swellable packer device positioned concentrically around the shroud of the connector sub which includes the valve.

2. The screen system according to claim 1, further comprising a fourth screen sub and third connector sub, wherein the third connector sub does not include a valve to create a fluid path between a central passage of the pipe coupling assembly and the connector annulus.

3. The screen system according to claim 1, wherein the connector sub without the valve has a perforated shroud.

4. The screen system according to claim 3, wherein the connector sub with the valve has a substantially unperforated shroud.

5. The screen system according to claim 1, wherein the valve is a pressure activated valve.

6. The screen system according to claim 1, wherein the connector subs are between about four feet and about ten feet in length.

7. The screen system according to claim 1, wherein the screen sections of the screen subs and the shrouds of the connector subs are joined by a linear movement connectors, the linear movement connectors including opposing pairs of ratchet teeth.

8. The screen system according to claim 7, wherein the linear movement connectors further comprise (i) screen end rings with a first set of ratchet teeth connected to the screen sections, and (ii) attachment rings with a second set of ratchet teeth connected to the shrouds, wherein the opposing ratchet teeth allowing linear movement of the end-rings and the attachment rings towards one another, but resisting linear movement of the end-rings and the attachment rings away from one another.

9. A method of utilizing a screen system in a hydrocarbon producing wellbore where at least part of the screen system is potentially subject to a high velocity solids laden fluid flow, the method comprising the steps of:

a. positioning a screen system in the wellbore, the screen system including:

i. at least first and second screen subs, each screen sub including a base pipe wrapped with a screen section to create a screen annulus;

ii. a first connector sub connecting the first and second screen subs, the connector sub comprising:

1. a pipe coupling assembly connecting the base pipes of the respective screen subs;

2. a substantially impermeable shroud formed around the pipe coupling assembly and creating a connector annulus between the shroud and pipe coupling assembly;

3. end rings including a substantially annular flow passage connecting the screen annuluses of the respective screen subs to the corresponding connector annulus;

4. a valve configured to be selectively openable in order to create a fluid path between a central passage of the pipe coupling assembly and the connector annulus; and b. positioning the screen system in the wellbore at a location where the shroud of the connector sub would, in the absence of being substantially impermeable, be subject to a solids laden radial fluid flow having either (i) a liquid velocity of over two feet per second, or (ii) a gas velocity of over ten feet per second.

10. The method according to claim 9, further comprising a second connector sub connecting the second screen sub to a third screen sub positioned in the wellbore, the second connector sub including a substantially impermeable shroud and not including a valve.

11. The method according to claim 10, wherein the screen subs and the connector subs are joined by a linear movement connectors which include an opposing pairs of ratchet teeth.

12. The method according to claim 10, wherein at least one swellable packer device is positioned concentrically around the shroud of at least one of the connector subs.

13. A method of creating an alternative inflow path for a screen system in a hydrocarbon producing wellbore, the method comprising the steps of:

a. positioning a screen system in the wellbore, the screen system including:

i. a plurality of screen subs, each screen sub including a base pipe wrapped with a screen section to create a screen annulus;

ii. a first connector sub connecting a first and second screen sub, the first connector sub comprising:

1. a pipe coupling assembly connecting the base pipes of the respective screen subs;
2. a substantially impermeable shroud formed around the pipe coupling assembly and creating a connector annulus between the shroud and pipe coupling assembly;
3. end rings including a substantially annular flow passage connecting the screen annuluses of the respective screen subs to the corresponding connector annuluses;
4. a valve configured to be selectively openable in order to create a fluid path between a central passage of the pipe coupling assembly and the connector annulus;

iii. a second connector sub connecting additional screen subs in the screen system, the second connector sub comprising:

1. a pipe coupling assembly connecting the base pipes of the respective screen subs;
2. a substantially impermeable shroud formed around the pipe coupling assembly and creating a connector annulus between the shroud and pipe coupling assembly;
3. end rings including a substantially annular flow passage connecting the screen annuluses of the respective screen subs to the corresponding connector annuluses; and b. positioning a plurality of shallow penetrating explosive charges within the pipe coupling assembly of the second connector sub and detonating the charges to thereby perforate the pipe coupling assembly while leaving the shroud substantially unperforated.

14. The method according to claim 13, further comprising the step, prior to positioning the perforating charges, of attempting and failing to open the valve in the first connector sub.

15. The method according to claim 13, wherein at least one swellable packer device is positioned concentrically around the shroud of the first connector sub.

16. The method according to claim 13, wherein the connector subs are between about four feet and about ten feet in length.

* * * * *